US005482575A

United States Patent [19]

Barzasi et al.

[11] Patent Number: 5,482,575

[45] Date of Patent: Jan. 9, 1996

[54] FE-RE-B TYPE MAGNETIC POWDER, SINTERED MAGNETS AND PREPARATION METHOD THEREOF

[75] Inventors: Alain Barzasi, Allevard, France; Hiroshi Nagata; Masato Sagawa, both of Kyoto, Japan; Fernand Vial, Meylan, France

[73] Assignee: Ugimag SA, St. Pierre D'Allevard, France

[21] Appl. No.: 160,652

[22] Filed: Dec. 2, 1993

[30] Foreign Application Priority Data

Dec. 8, 1992 [FR] France ..... 92 14995
Jul. 7, 1993 [FR] France ..... 93 08586

[51] Int. Cl.[6] ..... H01F 1/057
[52] U.S. Cl. ..... 148/302; 75/244
[58] Field of Search ..... 148/302; 75/244

[56] References Cited

U.S. PATENT DOCUMENTS

| | | | |
|---|---|---|---|
| 4,995,905 | 2/1991 | Sugawa | 75/244 |
| 5,123,974 | 6/1992 | Tenaud et al. | 148/302 |
| 5,200,001 | 4/1993 | Hirosawa et al. | 148/302 |

FOREIGN PATENT DOCUMENTS

| | | | |
|---|---|---|---|
| 0280372 | 8/1988 | European Pat. Off. . | |
| 517179 | 12/1992 | European Pat. Off. | 148/302 |
| 561650 | 9/1993 | European Pat. Off. | 148/302 |
| 5-74618 | 3/1993 | Japan | 148/302 |

OTHER PUBLICATIONS

Patent Abstracts of Japan, vol. 13, No. 246, (E–769)(3594) Jun. 8, 1989, JP–10 48 403.
Patent Abstracts of Japan, vol. 17, No.015 (E–1305) Jan. 12, 1993, JP–42 45 403.
Patent Abstracts of Japan, vol. 16, No.353 (M–1288) Jul. 30, 1992, JP–41 10 401.
Patent Abstracts of Japan, vol. 16, No. 375 (C–0973) Aug. 12, 1992, JP–41 20 238.

*Primary Examiner*—John Sheehan
*Attorney, Agent, or Firm*—Dennison, Meserole, Pollack & Scheiner

[57] ABSTRACT

A magnetic powder for the manufacture of sintered magnets of the RE-T-B family, where RE represents at least one rare earth, T represents at least one transition element and B represents boron, the powder possibly containing other minor elements, is constituted by a mixture of two powders (A) and (B):

a) Powder (A) consists of grains with a quadratic structure $RE_2T_{14}B$, T being mainly iron with Co/Fe<8%, and which may possibly contain up to 0.5% Al, up to 0.05% Cu and up to 4% in total of at least one element of the group V, Nb, Hf, Mo, Cr, Ti, Zr, Ta, W and unavoidable impurities, the Fisher granulometry being between 3.5 and 5 μm;

b) Powder (B) is rich in RE, contains Co, and has the following composition by weight:

RE 52–70%, comprising at least 40% (absolute value) of one or more light rare earth(s) selected from the group La, Ce, Pr, Nd, Sm, Eu; a hydrogen content (in ppm by weight) greater than 130×%RE; Co 20-35%; Fe 0–20%; B≦0–0.2%; Al 0.1–4%; and unavoidable impurities, the powder having a Fisher granulometry of between 2.5 and 3.5 μm.

Powder (B) may be produced by mixing a RE rich powder (C) which contains Co with a B rich powder (D).

7 Claims, 1 Drawing Sheet

FE-RE-B TYPE MAGNETIC POWDER, SINTERED MAGNETS AND PREPARATION METHOD THEREOF

The invention concerns a magnetic powder and sintered permanent magnets primarily containing a rare earth RE, at least one transition element T and boron, the magnetic powder being obtained by mixing two initial powders each having a different chemical composition and granulometry, and their method of preparation.

The following patent applications teach the use of a mixture of two initial alloys for the manufacture of sintered magnets:

Japanese application JP-A-63-114 939 describes magnets of the above type produced from a mixture of two powders, one containing magnetic grains of type $RE_2T_{14}B$, and the other which constitutes the "matrix", containing either low or high melting point elements. The application also states that this second powder must be extremely fine (0.02 to 1 μm), which is extremely costly.

Japanese application JP-A-2-31 402 concerns the use of a second powder constituted by RE-Fe-B or RE-Fe in the amorphous or microcrystalline state obtained by rapid solidification requiring specialised equipment.

It is therefore desirable to find a simpler and less onerous manufacturing method using conventional powder metallurgy to produce sintered magnets with better magnetic characteristics, in particular good remanance and high resistance to atmospheric corrosion.

Weight percentages and quantities will be used below, unless otherwise indicated.

In accordance with the invention, the initial powder is constituted by a mixture of two powders of different nature and granulometry, and is characterised in that:

a) Powder (A) is constituted by grains with a quadratic structure $RE_2T_{14}B$, T being primarily iron with Co/Fe< 8%, which may also contain up to 0.5% Al, up to 0.05% Cu and up to 4% in total of at least one element of the group V, Nb, Hf, Mo, Cr, Ti, Zr, Ta, W and unavoidable impurities, the Fisher granulometry being between 3.5 and 5 μm.

The total RE content is between 26.7 and 30%, preferably between 28 and 29%; the Co content is preferably limited to a maximum of 5%, even 2%. The aluminium content is preferably between 0.2 and 0.5%, more preferably between 0.25 and 0.35%; the Cu content is preferably between 0.02 and 0.05%, and most preferably between 0.025 and 0.035%. The B content is between 0.96 and 1.1%, preferably 1.0–1.06%. The remainder is constituted by Fe.

Powder (A) may be obtained from an alloy produced by melting (ingots) or by co-reduction (coarse powder), the ingots or coarse powder preferably being treated under $H_2$ under the following conditions: put under vacuum or scavenge chamber, introduction of an inert gas between 0.1 and 0.12 MPa, raise temperature at a rate of between 10° C./h and 500° C./h to a temperature of between 350° and 450° C., apply an absolute partial pressure of hydrogen of between 0.01 and 0.12 MPa and maintain these conditions for 1 to 4 hours, put under vacuum and introduce an inert gas at a pressure of 0.1 to 0.12 MPa, cool to room temperature at a rate of between 5° C./h and 100° C./h. Preferably, the inert gas used is argon or helium or a mixture of the two gases.

Powder (A) is then finely ground using a gas jet mill, preferably using nitrogen gas, at an absolute pressure of between 0.4 and 0.8 MPa, adjusting the granulometric selection parameters to produce a powder with a Fisher granulometry of between 3.5 and 5 μm.

b) Powder (B) is rich in RE, contains Co and has the following composition by weight:

RE 52–70%; comprising at least 40% (absolute value) of one or more light rare earth(s) selected from the group: La, Ce, Pr, Nd, Sm, Eu; a $H_2$ content (in ppm by weight) greater than 130×%RE; Co 20–35%; Fe 0–20%; B 0–0.2%; Al0.1–4%; and unavoidable impurities, the powder having a Fisher granulometry of between 2.5 and 3.5 μm.

Preferably, powder (B) is practically free of B (B content less than 0.05%).

This powder (B) is obtained from alloys which are treated under hydrogen under the following conditions: put under vacuum, introduction of an inert gas at a pressure of between 0.1 and 0.12 MPa, raise temperature at a rate of between 10° C./h and 500° C./h up to a temperature of between 350° and 450° C., introduction of hydrogen at an absolute partial pressure of between 0.01 and 0.12 MPa and maintain these conditions for 1 to 4 hours, then put under vacuum and introduce an inert gas at a pressure of 0.1 to 0.12 MPa, cool to room temperature at a rate of between 5° C./h and 100° C./h.

In addition, it is preferable that the above operation is preceded by treatment with hydrogen under the following conditions: maintain the initial alloy under hydrogen at an absolute partial pressure of between 0.01 and 0.12 MPa for 1 to 3 hours at room temperature.

If necessary, the prior or final hydrogen treatments indicated above can be repeated once or twice. Preferably, the inert gas used is argon or helium or a mixture of the two.

The powder mainly contains a RE hydride: $REH_{2+\epsilon}$, Co metal, and a little $NdCo_2$.

Powder (B) is then finely ground using a gas jet mill, preferably using nitrogen at an absolute pressure of between 0.4 and 0.7 MPa, adjusting the granulometric selection parameters to produce a powder with a Fisher granulometry of between 2.5 and 3.5 μm.

Preferably, powder (B) has a Fisher granulometry at least 20% less than that of powder (A).

As this powder (B) produces a secondary phase, it is preferable that the total fusion temperature (liquidus) of alloy (B) is lower than 1080° C.

c) Powders (A) and (B) are then mixed to produce the final composition of the magnet. In this, the rare earth content (RE) is generally between 29.0 and 32.0%, preferably between 29 and 31%, the boron content is between 0.94 and 1.04%, the cobalt content is between 1.0 and 4.3% by weight, the aluminium content is between 0.2 and 0.5%, the copper content is between 0.02 and 0.05% by weight, the remainder being iron and unavoidable impurities. The $O_2$ content of the magnetic powder resulting from mixture (A)+(B) is generally less than 3500 ppm. The proportion by weight of powder (A) in mixture (A)+(B) is between 88 and 95%, preferably between 90 and 94%.

The mixture of powders (A) and (B) is then oriented in a magnetic field parallel (//) or perpendicular (⊥) to the compression direction and compacted by any appropriate means, for example a press or by isostatic compression. The compressed bodies obtained, with a specific mass of between, for example, 3.5 and 4.5 g/cm$^3$, are sintered between 1050° C. and 1110° C. and thermally treated in the usual fashion.

The density obtained is between 7.45 and 7.65 g/cm$^3$.

The magnets may then undergo any necessary normal machining and surface coating operations.

Magnets in accordance with the invention belong to the RE-T-B family where RE represents at least one rare earth, T at least one transition element such as Fe and/or Co, B represents boron, and may if possibly contain other minor elements, and are mainly constituted by grains of the quadratic phase $RE_2Fe_{14}B$ termed "T1", a secondary phase containing mainly rare earths, and may contain other minor phases. These magnets have the following characteristics:

remanance: Br≧1.25 T (in // compression)

remanance: Br≧1.30 T (in ⊥ compression)

intrinsic coercive field HcI≧1050 kA/m (≅13 kOe).

More precisely, they have a structure consisting of grains of phase T1 constituting more than 94% of the structure, of substantially uniform size between 2 and 20 μm. These are surrounded by a narrow continuous margin of RE rich secondary phase of substantially uniform thickness not ≧5 μm. This secondary phase contains more than 10% cobalt.

However, magnetic retentivity, remanance and specific energy, although satisfactory, can be further improved by producing powder (B) from a mixture of two powders (C) and (D) without affecting other properties of the sintered magnets, in particular resistance to oxidation and atmospheric corrosion and machining by grinding. In addition, judicious choice of powder (D) can substantially reduce sintering temperature and duration.

In accordance with the invention, this additive powder (B) is obtained by mixing two different coarse powdered alloys (C) and (D) and milling them simultaneously. A coarse powder is a powder with particles passing through a 1 mm sieve.

a) Powder (C) is rich in RE, contains Co and has the following composition by weight:

RE 52–70%; comprising at least 40% (absolute) of one or more light rare earth(s) selected from the group: La, Ce, Pr, Nd, Sm, Eu; a hydrogen content (ppm by weight) of greater than 130×%RE; Co 20–35%; Fe 0–20%; B 0–0.2%; Al 0.1–4%; and unavoidable impurities.

Preferably, it is practically free of B (B content of less than 0.05%).

The coarse powder (C) is obtained from alloys which are treated under hydrogen under the following conditions: put under vacuum, introduction of an inert gas at a pressure of between 0.1 and 0.12 MPa, raise temperature at a rate of between 10° C./h and 500° C./h up to a temperature of between 350° and 450° C., introduction of hydrogen at an absolute partial pressure of between 0.01 and 0.12 MPa, and maintain these conditions for 1 to 4 hours, then put under vacuum and introduce an inert gas at a pressure of 0.1 to 0.12 MPa, cool to room temperature at a rate of between 5° C./h and 100° C./h.

In addition, it is preferable that the above operation is preceded by treatment with hydrogen under the following conditions: maintain the initial alloy under hydrogen at an absolute partial pressure of between 0.01 and 0.12 MPa for 1 to 3 hours at room temperature.

If necessary, the prior or final hydrogen treatments indicated above can be repeated once or twice. Preferably, the inert gas used is argon or helium or a mixture of the two.

This powder (C) mainly comprises a RE hydride: $REH_{2+\epsilon}$, Co metal, and a little $NdCo_2$.

b) Powder (D) may be obtained from an alloy containing boron alloyed with one or more elements of the series (Al, Si, V, Cr, Mn, Fe, Co, Ni, Cu, Nb, Mo) and containing between 5 and 70% by weight boron, with unavoidable impurities. It preferably comprises Fe based alloys containing between 5 and 30% (by weight) boron, up to 10% copper, up to 10% by weight aluminium, and up to 8% silicon. Powder (D) is practically free of rare earths (total content ≦0.05%).

These alloys, produced using conventional techniques, are then coarsely wet or dry milled using mechanical or gas jet mills. Coarse powder (D) is then mixed with coarse powder (C), which has been hydrided, to produce a final boron content of mixture (B)=(C)+(D) between 0.05 and 1.5%, preferably between 0.4 and 1.2%. Homogenised mixture (C)+(D) is then milled to a Fisher granulometry of 2.5 to 3.5 μm.

As powder (B) produces a secondary phase, it is necessary for the total fusion temperature (liquidus) to be less than 1050° C. Preferably, powder (B) has a Fisher granulometry of less than 20% of that of powder (A).

c) Powder (A) comprises grains with a quadratic structure $RE_2T_{14}B$, T being mainly iron with Co/Fe<8%, which may also contain up to 0.5% Al, up to 0.05% Cu and up to 4% in total of at least one element of the group V, Nb, Hf, Mo, Cr, Ti, Zr, Ta, W and unavoidable impurities, the Fisher granulometry being between 3.5 and 5 μm.

The total RE content is between 26.7 and 30%, preferably between 28 and 29%; the Co content is preferably limited to a maximum of 5%, even 2%. The aluminium content is preferably between 0.2 and 0.5%, more preferably between 0.25 and 0.35%; copper content is preferably between 0.02 and 0.05%, most preferably between 0.025 and 0.035%. The B content is between 0.95 and 1.05%, preferably 0.96–1.0%. The remainder is constituted by Fe.

The global composition may be very close to $RE_2T_{14}B$, copper and aluminium being assimilated as transition metals.

Powder (A) may be obtained from an alloy produced by melting (ingots) or by co-reduction (coarse powder), the ingots or coarse powder preferably being treated under $H_2$ under the following conditions: put under vacuum or scavenge chamber, introduction of an inert gas between 0.1 and 0.12 MPa, raise temperature at a rate of between 10° C./h and 500° C./h to a temperature of between 350° and 450° C., apply an absolute partial pressure of hydrogen of between 0.01 and 0.12 MPa and maintain these conditions for 1 to 4 hours, put under vacuum and introduce an inert gas at a pressure of 0.1 to 0.12 MPa, cool to room temperature at a rate of between 5° C./h and 100° C./h. Preferably, the inert gas used is argon or helium or a mixture of the two.

Powder (A) is then finely ground using a gas jet mill, preferably using nitrogen gas, at an absolute pressure of between 0.4 and 0.8 MPa, adjusting the granulometric selection parameters to produce a powder with a Fisher granulometry of between 3.5 and 5 μm.

d) Powders (A) and (B) are then mixed to produce the final composition of the magnet. In this, the rare earth content (RE) is generally between 29.0 and 32.0%, preferably between 29 and 31%, the boron content is between 0.93 and 1.04%, the cobalt content is between 1.0 and 4.3% by weight, the aluminium content is between 0.2 and 0.5%, the copper content is between 0.02 and 0.05% by weight, the remainder being iron and unavoidable impurities. The $O_2$ content of the magnetic powder resulting from mixture (A)+(B) is generally less than 3500 ppm. The proportion by weight of powder (A) in mixture (A)+(B) is between 88 and 95%, preferably between 90 and 94%.

The mixture of powders (A) and (B) is then oriented in a magnetic field parallel (//) or perpendicular (⊥) to the compression direction and compacted by any appropriate means, for example a press or by isostatic compression. The compressed bodies obtained, with a specific mass of between, for example, 3.5 and 4.5 g/cm$^3$, are sintered between 1050° C. and 1110° C. and thermally treated in the usual fashion.

The density obtained is between 7.45 and 7.65 g/cm$^3$.

The magnets may then undergo any necessary normal machining and surface coating operations.

Magnets in accordance with the invention belong to the RE-MT-B family where RE represents at least on rare earth, MT represents at least one transition element such as Fe and/or Co, B represents boron, and may possibly contain other minor elements, and are essentially constituted by grains of the quadratic phase $RE_2Re_{14}B$ termed "T1", a secondary phase containing mainly rare earths, and may contain other minor phases. These magnets have the following characteristics:

remanance: Br≧1.25 T (in // compression)

remanance: Br≧1.32 T (in ⊥ compression), even ≧ 1.35 T intrinsic coercive field HcJ≧1150 kA/m (=14.3 kOe).

More precisely, they have a structure consisting of grains of phase T1 constituting more than 94% of the structure, of substantially uniform size of between 2 and 20 μm. These are surrounded by a narrow continuous margin of RE rich secondary phase of substantially uniform thickness no ≧5 μm. This secondary phase contains more than 10% cobalt.

BRIEF DESCRIPTION OF THE DRAWINGS

The invention will be better understood from the following examples illustrated by FIGS. 1 and 2.

EXAMPLE 1

The 8 alloys whose compositions are shown in Table I were prepared as follows:

ingots vacuum cast hydrogen treatment under the following conditions:

put under vacuum introduction of argon at absolute pressure of 0.1 MPa heated at 50° C./h to 400° C.

put under vacuum introduction of argon+hydrogen mixture at absolute partial pressures of 0.06 MPa ($H_2$) and 0.07 MPa (Ar) and held for 2 h put under vacuum introduction of argon at 0.1 MPa and cooling to room temperature at 10° C./h milled with gas jet mill under nitrogen to Fisher granulometries shown in Table III.

The 10 alloys (B) whose compositions are shown in Table II were prepared as follows:

vacuum melting of ingots hydrogen treatment:

put under vacuum introduction of Ar+$H_2$ mixture at absolute partial pressures of 0.06 MPa ($H_2$) and 0.07 MPa (A) at room temperature over 2 h heated to 400° C. at 50° C./h in same atmosphere and maintained for 2 h put under vacuum introduction of argon at 0.1 MPa absolute and cooling to room temperature at 10° C./h milling in gas jet mill using nitrogen to Fisher granulometries shown in Table III.

Powders (A) and (B) produced were mixed in the proportions by weight shown in Table IV, then compressed in a magnetic field (// or ⊥), sintered and treated under the conditions indicated in Table V which also shows the density and magnetic characteristics of the magnets.

Magnets M1, M2, M3, M4, M5, M9 and M13 were in accordance with the invention; the others were outside the scope of the invention for the following reasons:

M6—powder (B) contained 1% B, above the limit and with poor densification.

M7—the proportion of powder (B) in mixture (A)+(B) is too small and produces poor dispersion of this powder (B) and poor densification.

M8—coercivity less than 1050 kA/m due to use of an alloy (B) with too low RE content.

M10—presence of V in alloy (B)—9% by weight—does not produce good properties.

M11—simultaneous presence of B and V in powder (B) produces losses in all the magnet's properties.

S1, S2, S3—these compositions were obtained using a mono-alloying method which did not produce sufficient densification, resulting in weak magnetic properties.

M12—identical composition to M1, but produced using powder (A1) mixed with powder (B9) which had not been treated with hydrogen but by mechanical pulverisation in an inert atmosphere before introduction into the gas jet mill.

Figure 1:
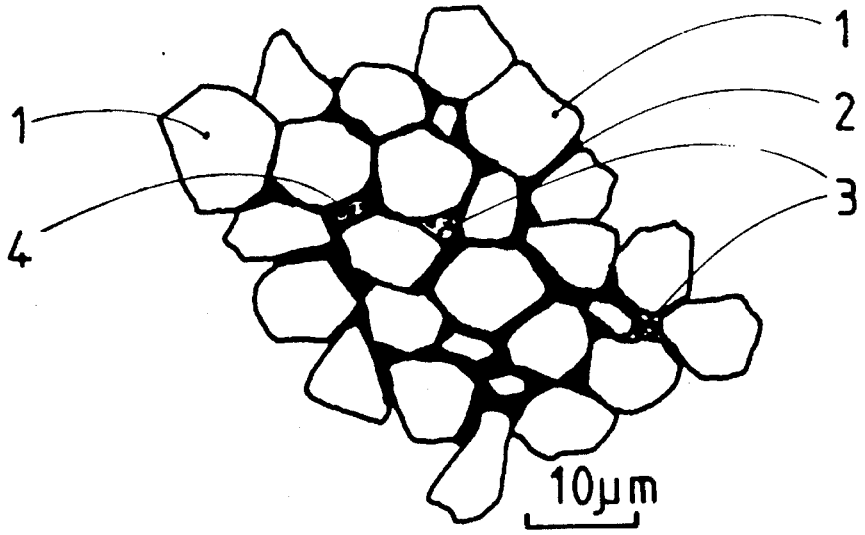
FIG. 1 schematically represents a micrographic section of a sintered magnet in accordance with the invention (M1)
Figure 2:
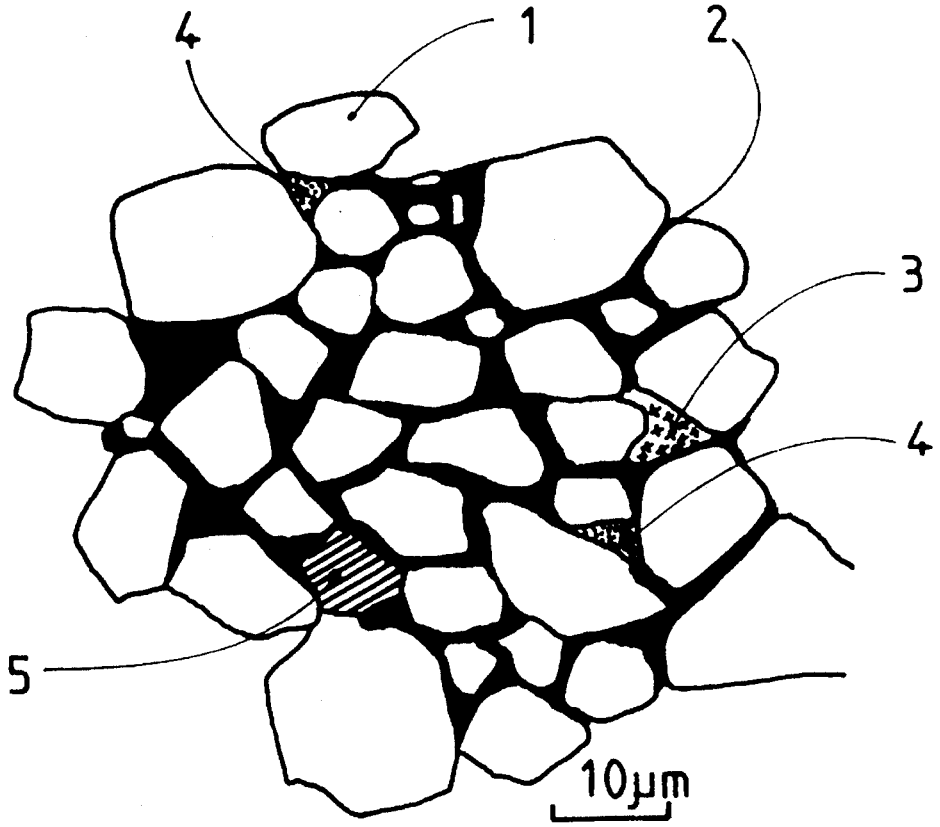
FIG. 2 schematically represents a micrographic section of a sintered magnet having the same composition obtained using a mono-alloying technique (S1).

FIGS. 1 and 2 schematically represent two micrographic sections taken on a scanning electron microscope equipped with an analytical probe, carried out on two magnets of the same composition corresponding to examples M1 and S1: M1 produced in accordance with the invention and S1 produced using the prior art mono-alloying technique.

The differences are as follows:

Magnet M1 has a homogeneous structure of fine grains of magnetic phase $RE_2Fe_{14}B$ -1- with an average size of 9 μm and 95% of the grains having a size less than 14 μm. The geometry is slightly angular.

The secondary phase, which is rich in RE -2-, is uniformly distributed in narrow margins around the magnetic phase grains $RE_2Re_{14}B$, without the presence of pockets with a size in excess of 4 μm.

There is no evidence of the presence of a $RE_{1+\epsilon}Fe_4B_4$ phase, intergranular porosity -3- is very low and the void diameter does not exceed 2 μm. There is only a small amount of an intergranular oxide phase -4-, the size of these oxides not exceeding 3 μm.

Quantitative analysis of cobalt in phase T1 ($RE_2Fe_{14}B$) and the secondary phase shows that the cobalt is primarily localised in the secondary intergranular phase with a content of greater than 10% by weight and that the magnetic phase $RE_2Re_{14}B$ -1- has only a very small cobalt content.

Magnet S1 is characterised by a microstructure consisting of grains of magnetic phase $RE_2Fe_{14}B$ -1- with an average size of 12 μm and a large number of grains of over 20 μm, some as much as 30 μm. In addition, the grains are generally angular in shape. The presence of a RE $Fe_4B_4$ -5- phase should be noted along with numerous large voids -3- which may have a diameter >5 μm.

Oxide accumulations -4- which may be >5 μm can be seen, primarily at triple joints.

The Co content of the Re rich secondary phase is very low and corresponds to the average content in the alloy, as in the magnetic phase $RE_2Fe_{14}B$.

The process of mixing the two powders (A) and (B) according to the invention has the following advantages over the prior art:

The production method for powder (B) containing primarily Co and RE results in fine homogenous dispersion of the constituents due to the hydrogen treatment. This in turn results in better densification, even for total RE contents which are lower than those of the prior art, and improved magnetic properties (Br, HcJ) as well as improved corrosion resistance;

the composition of powder (B) results in a RE rich secondary phase which has particular properties such as resistance to atmospheric corrosion, due to the Co, or better sinterability due to the Cu and Al.

Thus, for example, sintered magnets prepared in accordance with the invention (RE=30.5% by weight) and the prior art produced to the same density by a monoalloying metallurgical technique (RE=32% by weight) held in an autoclave at a relative pressure of 1.5 bar (0.15 MPa) for 120 h at 100° C. in a humid atmosphere (100% relative humidity) show the following weight losses:

| | |
|---|---|
| invention | 2 to $7.10^{-3}$ g/cm$^2$ |
| prior art | 3 to $7.10^{-2}$ g/cm$^2$ |

Magnets where the composition of the base and the added elements are comparable show a significantly different increase in resistance to corrosion: an increase of a factor of 10 for magnets according to the invention.

the microstructure of the sintered magnet is more homogeneous as regards grain size of T1 and good distribution of a smaller quantity of the RE rich phase results in significant improvement in the coercivity.

Within the defined range of mixing proportions of powders (A) and (B),variations in the boron and RE contents correspond practically to the optimum RE/B ratio which avoids formation of large amounts of phase $RE_{1+\epsilon}Fe_4B_4$ and thus confirms that the method allows great flexibility in powder composition to maximise the magnetic properties.

EXAMPLE 2

The 2 alloys (A) whose compositions are shown in Table VI were prepared as follows:

ingots vacuum cast hydrogen treatment under the following conditions:

put under vacuum introduction of argon at absolute pressure of 0.1 1 MPa heated at 50° C./h to 400° C.

introduction of argon+hydrogen mixture at absolute partial pressures of 0.06 MPa ($H_2$) and 0.07 MPa (Ar) and held for 2 h put under vacuum introduction of argon at 0.1 MPa and cooling to room temperature at 10° C./h milling with gas jet mill under nitrogen to Fisher granulometries shown in Table.

The 2 alloys (C) whose compositions are shown in Table VII, were prepared as follows:

vacuum melting of ingots hydrogen treatment:

put under vacuum introduction of Ar+$H_2$ mixture at absolute partial pressures of 0.06 MPa ($H_2$) and 0.07 MPa (A) at room temperature over 2 h heated to 400° C. at 50° C./h in same atmosphere and maintained for 2 h put under vacuum introduction of argon at 0.1 MPa absolute and cooling to room temperature at 10° C./h The maximum size of the coarse powder thus produced was less than 900 μm.

Alloy (D), whose composition is shown in Table VIII, was treated as follows:

mechanical pulverisation of an ingot under nitrogen to a granulometry <3 mm premilling in a gas jet mill under nitrogen to a granulometry <500 μm.

The 8 mixtures (B) of (C)+(D), whose compositions are shown in Table IX, were prepared as follows:

coarse powders (C) and (D) mixed in weight proportions given in Table IX homogenisation in a rotary mixer milling in a gas jet mill under nitrogen to the granulometries indicated in Table X.

Powders (A) and (B) thus obtained were mixed in the proportions by weight shown in Table XI, then compressed in a (⊥) field, sintered and subsequently treated under the conditions shown in Table XII which also lists the magnetic characteristics of the magnets.

Magnets M7–M8; M11–M12; M23–M24; M27; M28 correspond to the invention. The remaining magnets fall outside the scope of the invention as claimed for the following reasons:

M13 to M16 and M29 to M32 contain alloy (B) with too high a B content;

M1, M2, M3, M4, M17, M18, M19, M20 were produced from mixtures wherein powder (B) had no addition of powder (D). Consequently, the remanance value of the magnets was always less than that for identical compositions in accordance with the invention.

Examples M5, M6, M9, M10, M13, M14, M21, M22, M25, M26, M29, M30 were produced from powders (B) containing powder (D), but used a powder (A) with a high boron content (1.06%) and had a remanance of less than 1.32 T.

Examples M31 and M32 were produced from powders (B) containing powder (D) and from powder (A) with a low boron content (0.98% by weight), but the magnets had a slightly lower remanance of 1.32 T because powder (B) had a B content >15%.

Magnets in accordance with the invention have the same structural characteristics as those described above: absence of $Nd_{1+\epsilon}Fe_4B_4$, homogeneous grain structure with only slightly angular size and shape, secondary phase uniformly distributed in narrow margins where the Co preferentially locates itself.

The process of the invention has the following advantages:

Example 1 produces better densification and sintering at lower temperature and/or lower duration, improving residual induction and coercivity.

Additive powder (B) contains all the addition elements necessary to form the RE rich phase during the sintering operation which is carried out at a lower temperature (1050° C.–1070° C.). This phase is liquid, and contains cobalt and other elements such as aluminium, copper, silicon and impurities. During cooling after sintering an additional magnetic phase $RE_2Fe_{14}B$ is formed without the need to dissolve, with difficulty, the phase $TR_{1+\epsilon}Fe_4B_4$ as required in the prior art. This results in magnetic properties with high values.

The sintered magnet of the invention does not contain a $TR_{1+\epsilon}Fe_4B_4$ phase.

The hydriding treatment of powder (C) produces, as in the prior art, a fine and homogeneous constituent dispersion and thus facilitates densification during sintering at low temperature even for low RE contents and higher magnetic property values (Br, Hcj) as well as improved corrosion resistance.

Addition of powder (D) containing boron in powder (C) permits fine adjustment of the final content of this element to maximise the final remanance of the magnet.

TABLE I

| | Compositions (A) (weight %) | | | | | | |
|---|---|---|---|---|---|---|---|
| | Nd | Dy | B | Al | V | Cu | Fe |
| A1 | 27,0 | 1,5 | 1,06 | 0,3 | 0 | 0,03 | bal |
| A2 | 27,5 | 1,0 | 1,06 | 0,3 | 0 | 0,03 | bal |
| A3 | 26,0 | 1,5 | 1,06 | 0,3 | 0 | 0,03 | bal |
| A4 | 27,0 | 1,5 | 1,0 | 0,3 | 0 | 0,03 | bal |
| A5 | 27,0 | 1,5 | 1,15 | 0,3 | 0 | 0,03 | bal |
| A6 | 28,1 | 0 | 1,17 | 0 | 1,0 | 0,03 | 69,43 |
| A7 | 28,1 | 0 | 1,13 | 0 | 0 | 0,03 | 70,7 |
| A8 | 28,1 | 0 | 1,0 | 0 | 0 | 0,03 | 70,9 |

TABLE II

| | Compositions (B) (weight %) | | | | | | | |
|---|---|---|---|---|---|---|---|---|
| | Nd | Dy | Co | Fe | Al | V | Cu | B |
| B1 | 59,1 | 1,5 | 32,0 | 7,1 | 0,3 | 0 | 0,03 | 0 |
| B2 | 59,8 | 1,0 | 32,0 | 6,9 | 0,3 | 0 | 0,03 | 0 |
| B3 | 59,0 | 1,5 | 32,0 | 6,1 | 0,3 | 0 | 0,03 | 1,05 |
| B4 | 67,2 | 1,5 | 31,0 | 0 | 0,3 | 0 | 0,03 | 0 |
| B5 | 50,0 | 1,5 | 33,0 | 15,2 | 0.3 | 0 | 0,03 | 0 |
| B6 | 52,0 | 10,0 | 33,0 | 2,0 | 3,0 | 0 | 0,03 | 0 |
| B7 | 52,0 | 10,0 | 24,0 | 2,0 | 3,0 | 9,0 | 0,03 | 0 |
| B8 | 52,0 | 10,0 | 24,0 | 1,0 | 3,0 | 9,0 | 0,03 | 1,10 |
| B9 | 59,1 | 1,5 | 32,0 | 7,1 | 0,3 | 0 | 0,03 | 0 |
| B10 | 59,1 | 1,5 | 32,0 | 6,9 | 0,3 | 0 | 0,03 | 0,2 |

TABLE III

| | Powder characteristics | |
|---|---|---|
| Reference | FSSS* | O2 ppm |
| A1 | 4,5 | 2900 |
| A2 | 4,7 | 3100 |
| A3 | 4,5 | 2800 |
| A4 | 4,7 | 2800 |
| A5 | 4,8 | 3000 |
| A6 | 4,2 | 3000 |
| A7 | 4,5 | 3200 |
| A8 | 4,6 | 2900 |
| B1 | 3,2 | 5100 |
| B2 | 3,3 | 4800 |
| B3 | 3,9 | 6000 |
| B4 | 3,1 | 5200 |
| B5 | 3,4 | 4800 |
| B6 | 3,5 | 5000 |
| B7 | 3,4 | 4900 |
| B8 | 3,3 | 5200 |
| B9 | 3,4 | 10200 |
| B10 | 3,3 | 5500 |

*FSSS: Fisher-Sub Size Sieve in μm.

TABLE IV

| | | | | Mixture compositions (weight %) | | | | | | | | |
|---|---|---|---|---|---|---|---|---|---|---|---|---|
| | (A) | (B) | % (B)* | Nd | Dy | B | Co | Al | Cu | V | Fe | O2*** |
| M1 | A1 | B1 | 6% | 28,9 | 1,5 | 1,0 | 1,9 | 0,3 | 0,03 | 0 | Reste | 3200 |
| M2 | A2 | B2 | 6% | 29,5 | 1,0 | 1,0 | 1,9 | 0,3 | 0,03 | 0 | " | 2900 |
| M3 | A3 | B1 | 6% | 28,0 | 1,5 | 1,0 | 1,9 | 0,3 | 0,03 | 0 | " | 3100 |
| M4 | A4 | B1 | 6% | 28,9 | 1,5 | 0,94 | 1,9 | 0,3 | 0,03 | 0 | " | 3100 |
| M5 | A5 | B1 | 6% | 28,9 | 1,5 | 1,08 | 1,9 | 0,3 | 0,03 | 0 | " | 3200 |
| M6 | A4 | B3 | 6% | 28,9 | 1,5 | 1,0 | 1,9 | 0,3 | 0,03 | 0 | " | 3800 |
| M7 | A1 | B4 | 4% | 28,6 | 1,5 | 1,02 | 1,2 | 0,3 | 0,03 | 0 | " | 3100 |
| M8 | A1 | B5 | 9% | 29,1 | 1,5 | 0,96 | 3,0 | 0,3 | 0,03 | 0 | " | 2900 |
| M9 | A6 | B6 | 10% | 30,5 | 1,0 | 1,05 | 3,3 | 0,3 | 0,03 | 0,9 | " | 3100 |
| M10 | A7 | B7 | 10% | 31,0 | 1,0 | 1,0 | 2,4 | 0,3 | 0,03 | 0,8 | " | 3200 |
| M11 | A8 | B8 | 10% | 31,0 | 1,0 | 1,0 | 2,4 | 0,3 | 0,03 | 0,8 | " | 3600 |
| M12 | A1 | B9 | 6% | 28,9 | 1,5 | 1,0 | 1,9 | 0,3 | 0,03 | 0 | " | 3800 |
| M13 | A1 | B10 | 6% | 28,9 | 1,5 | 1,0 | 1,9 | 0,3 | 0,03 | 0 | " | 3100 |
| S1** | | | | 28,9 | 1,5 | 1,0 | 1,9 | 0,3 | 0,03 | 0 | " | 3700 |
| S2 | | | | 29,4 | 1,0 | 1,0 | 1,9 | 0,3 | 0,03 | 0 | " | 3800 |
| S3 | | | | 29,0 | 1,5 | 1,08 | 1,9 | 0,3 | 0,03 | 0 | " | 3900 |

*weight %

**S1, S2, S3 are alloys with identical compositions to those of M1, M2, M3 respectively, obtained by direct fusion.

***$O_2$ in ppm.

TABLE V

| | Compression mode* | Vacuum sintering conditions | Vacuum annealing conditions | Vacuum tempering conditions | d | Br (T) | Hcj (kA/m) | (BH)max kJ/m³ |
|---|---|---|---|---|---|---|---|---|
| | | | Characteristics of magnets | | | | | |
| M1 | // | 1080° C. - 16 h | 800° C. - 1 h | 580° C. - 1 h | 7,55 | 1,285 | 1100 | 305 |
| | ⊥ | " | " | " | 7,55 | 1,340 | 1090 | 340 |
| M2 | // | " | " | " | 7,55 | 1,295 | 1010 | 315 |
| | ⊥ | " | " | " | 7,55 | 1,350 | 1000 | 350 |
| M3 | // | " | " | " | 7,50 | 1,25 | 1115 | 295 |
| | ⊥ | " | " | " | 7,52 | 1,30 | 1115 | 325 |
| M4 | // | " | " | " | 7,55 | 1,25 | 1100 | 295 |
| | ⊥ | " | " | " | 7,55 | 1,30 | 1100 | 325 |
| M5 | // | " | " | " | 7,55 | 1,27 | 1075 | 300 |
| | ⊥ | " | " | " | 7,55 | 1,33 | 1065 | 340 |
| M6* | // | " | " | " | 7,20 | 1,17 | 540 | 230 |
| M7 | // | " | " | " | 7,30 | 1,23 | 915 | 270 |
| M8 | // | " | " | " | 7,45 | 1,26 | 955 | 295 |
| M9 | // | 1090° C. - 16 h | " | " | 7,55 | 1,25 | 1115 | 295 |
| | ⊥ | " | " | " | 7,55 | 1,30 | 1115 | 325 |
| M10 | // | 1100° C. - 16 h | " | " | 7,51 | 1,22 | 795 | 295 |
| M11 | // | " | " | " | 7,40 | 1,19 | 710 | 255 |
| M12 | // | 1100° C. - 16 h | " | " | 6,90 | 0,8 | 100 | — |
| M13 | // | 1080° C. - 16 h | " | " | 7,45 | 1,24 | 950 | 285 |
| M14 | // | 1090° C. - 16 h | " | " | 7,50 | 1,25 | 1190 | 295 |
| S1 | // | 1080° C. - 16 h | " | " | 7,35 | 1,21 | 715 | 295 |
| S2 | // | " | " | " | 7,30 | 1,18 | 555 | — |
| S3 | // | " | " | " | 7,32 | 1,20 | 650 | — |

*Conventional press.

TABLE VI

| | Nd | Dy | B | Al | Cu | Si | Fe |
|---|---|---|---|---|---|---|---|
| | | Compositions (A) (weight %) | | | | | |
| A1 | 27,0 | 1,5 | 1,06 | 0,3 | 0,03 | 0,05 | remainder |
| A2 | 27,0 | 1,5 | 0,98 | 0,3 | 0,03 | 0,05 | remainder |

TABLE VIII

| | B | Al | Cu | Si | Fe |
|---|---|---|---|---|---|
| | Composition (D) (weight %) | | | | |
| D1 | 17,0 | 2,0 | 0,5 | 0,5 | remainder |

TABLE IX

| .addtif | (C) | (D) | (C)* | (D)* | Nd | Dy | B | Co | Al | Cu | Si | Fe |
|---|---|---|---|---|---|---|---|---|---|---|---|---|
| | | | Composition (B) = mixtures (C) + (D) (weight %) | | | | | | | | | |
| B1 | C1 | D1 | 100 | 0 | 59,1 | 1,5 | 0 | 32,0 | 0,3 | 0,03 | 0,05 | reste |
| B2 | C1 | D1 | 97 | 3 | 57,3 | 1,5 | 0,50 | 31,0 | 0,4 | 0,04 | 0,06 | " |
| B3 | C1 | D1 | 94 | 6 | 55,6 | 1,4 | 1,00 | 30,0 | 0,4 | 0,06 | 0,08 | " |
| B4 | C1 | D1 | 90 | 10 | 53,2 | 1,4 | 1,70 | 29,0 | 0,5 | 0,08 | 0,08 | " |
| B5 | C2 | D1 | 100 | 0 | 59,1 | 1,5 | 0,20 | 32,0 | 0,3 | 0,03 | 0,05 | " |
| B6 | C2 | D1 | 98 | 2 | 57,9 | 1,5 | 0,50 | 31,4 | 0,3 | 0,04 | 0,06 | " |
| B7 | C2 | D1 | 95 | 5 | 56,1 | 1,4 | 1,04 | 30,4 | 0,4 | 0,06 | 0,08 | " |
| B8 | C2 | D1 | 90 | 10 | 53,2 | 1,4 | 1,88 | 29,0 | 0,5 | 0,08 | 0,08 | " |

Proportions in weight % of (C) or (D) in mixture (B) = (C) + (D).

TABLE VII

| | Nd | Dy | B | Co | Al | Cu | Si | Fe |
|---|---|---|---|---|---|---|---|---|
| | | | Compositions (C) (weight %) | | | | | |
| C1 | 59,1 | 1,5 | 0 | 32,0 | 0,3 | 0,03 | 0,05 | remainder |
| C2 | 59,1 | 1,5 | 0,2 | 32,0 | 0,3 | 0,03 | 0,05 | remainder |

TABLE X

| Reference | FSSS* | $O_2$ ppm |
|---|---|---|
| | Characteristics of fine powders | |
| A1 | 4,1 | 2 800 |
| A2 | 4,2 | 3 100 |
| B1 | 3,0 | 4 300 |
| B2 | 2,8 | 5 500 |

TABLE X-continued

| Characteristics of fine powders | | |
|---|---|---|
| Reference | FSSS* | $O_2$ ppm |
| B3 | 3,3 | 4 600 |
| B4 | 3,1 | 4 800 |
| B5 | 2,8 | 4 700 |
| B6 | 2,5 | 6 200 |
| B7 | 3,1 | 5 000 |
| B8 | 2,9 | 5 100 |

*FSSS: Fisher Sub Size Sieve in μm.

TABLE XI

| | | | | | Composition (M): mixtures (A) + (B) | | | | | | | | |
|---|---|---|---|---|---|---|---|---|---|---|---|---|---|
| (M) | (A) | (B) | % (A) | % (B) | Nd | Dy | B | Co | Al | Cu | Si | Fe | O2* |
| M1 | A1 | B1 | 94 | 6 | 28,9 | 1,5 | 1,00 | 1,92 | 0,3 | 0,03 | 0,05 | reste | 3300 |
| M2 | A1 | B1 | 90 | 10 | 30,2 | 1,5 | 0,95 | 3,20 | 0,3 | 0,03 | " | " | 3200 |
| M3 | A2 | B1 | 94 | 6 | 28,9 | 1,5 | 0,92 | 1,92 | " | 0,03 | " | " | 3500 |
| M4 | A2 | B1 | 90 | 10 | 30,2 | 1,5 | 0,88 | 3,20 | " | 0,03 | " | " | 3000 |
| M5 | A1 | B2 | 94 | 6 | 28,8 | 1,5 | 1,03 | 1,86 | " | " | " | " | 3100 |
| M6 | A1 | B2 | 90 | 10 | 30,0 | 1,5 | 1,00 | 3,10 | " | " | " | " | 3500 |
| M7 | A2 | B2 | 94 | 6 | 28,8 | 1,5 | 0,95 | 1,86 | " | " | " | " | 3200 |
| M8 | A2 | B2 | 90 | 10 | 30,0 | 1,5 | 0,93 | 3,10 | " | " | " | " | 3400 |
| M9 | A1 | B3 | 94 | 6 | 28,7 | 1,5 | 1,06 | 1,80 | " | " | " | " | 2900 |
| M10 | A1 | B3 | 90 | 10 | 29,9 | 1,5 | 1,09 | 3,00 | " | " | " | " | 2800 |
| M11 | A2 | B3 | 94 | 6 | 28,7 | 1,5 | 1,10 | 1,80 | " | " | " | " | 2700 |
| M12 | A2 | B3 | 90 | 10 | 29,9 | 1,5 | 0,98 | 3,00 | " | " | " | " | 3000 |
| M13 | A1 | B4 | 94 | 6 | 28,6 | 1,5 | 1,10 | 1,74 | " | " | " | " | 3100 |
| M14 | A1 | B4 | 90 | 10 | 29,6 | 1,5 | 1,12 | 2,90 | " | " | " | " | 3400 |
| M15 | A2 | B4 | 94 | 6 | 28,6 | 1,5 | 1,02 | 1,74 | " | " | " | " | 3200 |
| M16 | A2 | B4 | 90 | 10 | 29,6 | 1,5 | 1,05 | 2,90 | " | " | " | " | 3000 |
| M17 | A1 | B5 | 94 | 6 | 28,9 | 1,5 | 1,00 | 1,92 | " | " | " | " | 2900 |
| M18 | A1 | B5 | 90 | 10 | 30,2 | 1,5 | 0,97 | 3,20 | " | | | | 3400 |
| M19 | A2 | B5 | 94 | 6 | 28,9 | 1,5 | 0,93 | 1,92 | " | " | " | " | 3200 |
| M20 | A2 | B5 | 90 | 10 | 30,2 | 1,5 | 0,90 | 3,20 | " | " | " | " | 3300 |
| M21 | A1 | B6 | 94 | 6 | 28,9 | 1,5 | 1,03 | 1,88 | " | " | " | " | 2800 |
| M22 | A1 | B6 | 90 | 10 | 30,1 | 1,5 | 1,00 | 3,14 | " | " | " | " | 2900 |
| M23 | A2 | B6 | 94 | 6 | 28,9 | 1,5 | 0,95 | 1,88 | " | " | " | " | 3000 |
| M24 | A2 | B6 | 90 | 10 | 30,1 | 1,5 | 0,93 | 3,14 | " | " | " | " | 3100 |
| M25 | A1 | B7 | 94 | 6 | 28,7 | 1,5 | 1,06 | 1,82 | " | " | " | " | 3400 |
| M26 | A1 | B7 | 90 | 10 | 29,9 | 1,5 | 1,06 | 3,04 | " | " | " | " | 3200 |
| M27 | A2 | B7 | 94 | 6 | 28,7 | 1,5 | 0,98 | 1,82 | " | " | " | " | 3000 |
| M28 | A2 | B7 | 90 | 10 | 29,9 | 1,5 | 0,99 | 3,04 | " | " | " | " | 3100 |
| M29 | A1 | B8 | 94 | 6 | 28,6 | 1,5 | 1,11 | 1,74 | " | " | " | " | 3000 |
| M30 | A1 | B8 | 90 | 10 | 29,6 | 1,5 | 1,03 | 2,90 | " | " | " | " | 2900 |
| M31 | A2 | B8 | 94 | 6 | 28,6 | 1,5 | 1,03 | 1,74 | " | " | " | " | 3300 |
| M32 | A2 | B8 | 90 | 10 | 29,6 | 1,5 | 1,07 | 2,90 | " | " | " | " | 3100 |

*ppm.

TABLE XII

| | Magnet characteristics* | | | | | | |
|---|---|---|---|---|---|---|---|
| | Sintering conditions, °C. - hrs | Annealing conditions, °C. - hrs | Tempering conditions, °C. - hrs | d | Br (T) | HcJ (kA/m) | (BH)max (kJ/m3) |
| M1 | 1080 - 4 | 800 - 1 | 580 - 1 | 7,37 | 1,30 | 1100 | 320 |
| M2 | 1070 - 4 | " | " | 7,31 | 1,27 | 1140 | 304 |
| M3 | 1060 - 4 | " | " | 7,55 | 1,30 | 960 | 320 |
| M4 | 1060 - 4 | " | " | 7,58 | 1,28 | 1100 | 309 |
| M5 | 1060 - 4 | " | " | 7,37 | 1,30 | 1080 | 320 |
| M6 | 1050 - 4 | " | " | 7,38 | 1,28 | 1190 | 309 |
| M7 | 1060 - 4 | " | " | 7,58 | 1,36 | 1200 | 350 |
| M8 | 1050 - 4 | " | " | 7,56 | 1,32 | 1250 | 330 |
| M9 | 1060 - 4 | " | " | 7,33 | 1,29 | 1050 | 314 |
| M10 | 1050 - 4 | " | " | 7,37 | 1,27 | 1120 | 304 |

TABLE XII-continued

| | Sintering conditions, °C. - hrs | Annealing conditions, °C. - hrs | Tempering conditions, °C. - hrs | d | Br (T) | HcJ (kA/m) | (BH)max (kJ/m3) |
|---|---|---|---|---|---|---|---|
| | | | Magnet characteristics* | | | | |
| M11 | 1060 - 4 | " | " | 7,58 | 1,35 | 1150 | 333 |
| M12 | 1050 - 4 | " | " | 7,58 | 1,32 | 1250 | 330 |
| M13 | 1060 - 4 | " | " | 7,40 | 1,30 | 980 | 320 |
| M14 | 1050 - 4 | " | " | 7,42 | 1,28 | 1200 | 309 |
| M15 | 1060 - 4 | " | " | 7,35 | 1,30 | 1200 | 320 |
| M16 | 1050 - 4 | " | " | 7,43 | 1,29 | 1280 | 314 |
| M17 | 1060 - 4 | " | " | 7,36 | 1,30 | 1000 | 320 |
| M18 | 1050 - 4 | " | " | 7,39 | 1,28 | 1080 | 309 |
| M19 | 1060 - 4 | " | " | 7,38 | 1,31 | 1130 | 330 |
| M20 | 1050 - 4 | " | " | 7,40 | 1,26 | 950 | 300 |
| M21 | 1060 - 4 | " | " | 7,39 | 1,30 | 1100 | 320 |
| M22 | 1050 - 4 | " | " | 7,39 | 1,28 | 1200 | 309 |
| M23 | 1060 - 4 | " | " | 7,58 | 1,35 | 1200 | 344 |
| M24 | 1050 - 4 | " | " | 7,56 | 1,32 | 1150 | 330 |
| M25 | 1060 - 4 | " | " | 7,41 | 1,30 | 1090 | 320 |
| M26 | 1050 - 4 | " | " | 7,36 | 1,27 | 1080 | 304 |
| M27 | 1060 - 4 | " | " | 7,58 | 1,35 | 1160 | 344 |
| M28 | 1050 - 4 | " | " | 7,57 | 1,32 | 1150 | 330 |
| M29 | 1060 - 4 | " | " | 7,41 | 1,37 | 960 | 320 |
| M30 | 1050 - 4 | " | " | 7,30 | 1,27 | 1020 | 304 |
| M31 | 1060 - 4 | " | " | 7,35 | 1,30 | 1180 | 320 |
| M32 | 1050 - 4 | " | " | 7,55 | 1,31 | 1100 | 323 |

*Perpendicular compression.

What is claimed is:

1. Sintered RE-T-B magnet where RE represents at least one rare earth element, T represents at least two transition elements Fe and Co, and B represents boron, optionally containing other minor elements and having a structure consisting essentially of grains of quadratic phase (T1) $RE_2T_{14}B$, a RE rich secondary phase containing at least 10 by weight Co, and optionally other minor phases, the Co being primarily located in the secondary phase, said structure consisting essentially of said grains of said quadratic phase(T1) surrounded by a narrow continuous margin of said secondary phase of a substantially uniform thickness of not more than 5 μm, and having an intergranular porosity of a diameter less than 2 μm.

2. Magnet according to claim 1, containing less than 3500 ppm of oxygen.

3. Sintered permanent magnet according to claim 1, comprising, by weight, 29 to 32% RE, 0.93 to 1.04% B, 1 to 4.3% Co, 0.2 to 0.5% Al, 0.02 to 0.05% Cu, the remainder consisting essentially of Fe and unavoidable impurities, said magnet having a remanance greater than 1.32 T.

4. Permanent magnet according to claim 3, having a remanance greater than 1.35 T.

5. Permanent magnet according to claim 1 having an the intrinsic coercivity greater than 1150 kA/m.

6. Permanent magnet according to claim 1, having a remanance >1.25 T.

7. Permanent magnet according to claim 1, wherein the grains of T1 phase have a size between 2 and 20 μm.

* * * * *